US007555821B2

(12) United States Patent
Thomeczek et al.

(10) Patent No.: US 7,555,821 B2
(45) Date of Patent: Jul. 7, 2009

(54) METHOD FOR CONFIGURING A HANDLE USED ON A MACHINE TOOL

(75) Inventors: James R. Thomeczek, Beavercreek, OH (US); Thomas A. Thomeczek, Xenia, OH (US); Scott R. Williamson, Beavercreek, OH (US)

(73) Assignee: Northwestern Tools, Inc., Dayton, OH (US)

( * ) Notice: Subject to any disclaimer, the term of this patent is extended or adjusted under 35 U.S.C. 154(b) by 217 days.

(21) Appl. No.: 11/763,735

(22) Filed: Jun. 15, 2007

(65) Prior Publication Data

US 2007/0241521 A1 Oct. 18, 2007

Related U.S. Application Data

(62) Division of application No. 10/745,451, filed on Dec. 23, 2003, now Pat. No. 7,255,020.

(51) Int. Cl.

| | |
|---|---|
| ***B21D 53/00*** | (2006.01) |
| ***B23P 11/00*** | (2006.01) |
| ***G05G 5/06*** | (2006.01) |
| ***G05G 1/10*** | (2006.01) |

(52) U.S. Cl. ..... 29/525.01; 29/525.11; 29/242; 29/243; 29/278; 29/896.5; 279/156; 74/527; 74/553; 81/177.2

(58) Field of Classification Search ..... 29/896.5, 29/525.01, 525.02, 525.11, 242, 243, 278; 279/156; 74/527, 528, 553, 557; 81/73, 81/37, 177.2

See application file for complete search history.

(56) References Cited

U.S. PATENT DOCUMENTS

| | | | |
|---|---|---|---|
| 2,569,069 | A | 6/1951 | Motel |
| 2,687,724 | A | 8/1954 | Ziherl et al. |
| 3,402,905 | A | 9/1968 | MacMillan |
| 4,309,123 | A | 1/1982 | Moore |
| 5,349,886 | A | 9/1994 | Jin |
| 5,395,312 | A | 3/1995 | Desai |
| 6,796,211 | B1 | 9/2004 | Braunberger |
| 2003/0213343 | A1 | 11/2003 | Schuster |
| 2005/0243553 | A1 | 11/2005 | Picone |

OTHER PUBLICATIONS

Northwestern Product Guide for Tooling and Manufacturing, Catalog #61, pp. 1-3 and 49 (2005).

Hand Retractable Plungers—Threaded Adapter-Locking, pp. 1-3 (2007).

Hand Retractable Plungers—Innovative Design Solution, 1-3 (2000-2003).

Northwestern Product Guide for Tooling and Manufacturing, Catalog #60, by Northwestern Tools, Inc. (date unknown).

*Primary Examiner*—Jermie E Cozart
(74) *Attorney, Agent, or Firm*—Thompson Hine LLPO

(57) ABSTRACT

A plunger with interchangeable handle system for machine tools. The plunger includes a shank adapted to engage a machine tool and having a retractable plunger and a threaded adapter, the interchangeable handle system includes a plurality of knobs, each having a discrete shape differing from the others and a socket to receive the threaded adapter of the shank.

3 Claims, 5 Drawing Sheets

METHOD FOR CONFIGURING A HANDLE USED ON A MACHINE TOOL

The present application is a divisional application of U.S. Ser. No. 10/745,451 filed on Dec. 23, 2003 now U.S. Pat. No. 7,255,020, the entire contents of which are incorporated herein by reference.

BACKGROUND

The present invention relates to machine tools and, more particularly, to hand-retractable plungers for use with machine tools.

Hand-retractable plungers are a common component of machine tools and are used to position parts of the tool, such as cutting implements, workpiece supports and the like, relative to the rest of the tool. Typically, such plungers include a handle portion of a pre-selected shape permanently attached to a spring-loaded plunger slidably received within a threaded barrel. The barrel is threaded into a component of a machine tool such that the end of the plunger opposite the handle portion protrudes from the component. The handle portion can be pulled to retract the plunger end into the barrel to provide clearance so that the component can be moved relative to the machine tool. When the component has been positioned as desired, the handle is released, thereby releasing the plunger, which then protrudes from the barrel and component into a locating hole on the machine tool.

The handle portion of a hand-retractable plunger may be a pull ring, bar, knurled knob or any other like knob or handle that allows a user to grip the plunger firmly. However, a disadvantage with current hand-retractable plungers is that a user may desire to use a plunger with a specific handle portion, or may wish to change the type of handle portion used on a particular plunger. Such a decision is typically based on user comfort, safety, or the particular application of the plunger. However, at present, changing the type of handle portion requires replacing the entire hand-retractable plunger.

Accordingly, there is a need for a hand-retractable plunger that can be adapted to accommodate a plurality of handle types and sizes.

SUMMARY

The present invention provides an interchangeable handle system for use with a hand-retractable plunger that includes a plunger body and a plurality of knobs of different shapes. Each of the knobs attaches to a shank portion, comprised of a plunger portion and a threaded adapter, of the plunger body. A threaded insert is positioned in a socket of each of the various types of knobs. The knobs each may be attached to the shank portion by screwing the threaded insert of an individual knob onto the threaded adapter of the shank portion.

The various shapes of knobs of the present invention provide a user the opportunity to select a knob for the plunger that is best suited for that user and for the application. Also, once a plunger is mounted on a machine tool or other device, a user may change the knob to one of a different shape or replace a knob that has become damaged, thereby reducing the cost of changing or replacing a plunger simply to change or replace the knob.

Other features, objects and advantages of the present invention will become apparent to those with ordinary skill in the art in view of the following drawings, detailed description and the appended claims. It is intended that all such additional features and advantages be included herein within the scope of the present invention.

BRIEF DESCRIPTION OF THE DRAWINGS

The invention can be understood with reference to the following drawings. In the drawings, like reference numerals designate corresponding parts throughout the several views. Also, the components in the drawings are not necessarily to scale.

DETAILED DESCRIPTION

Figure 1:
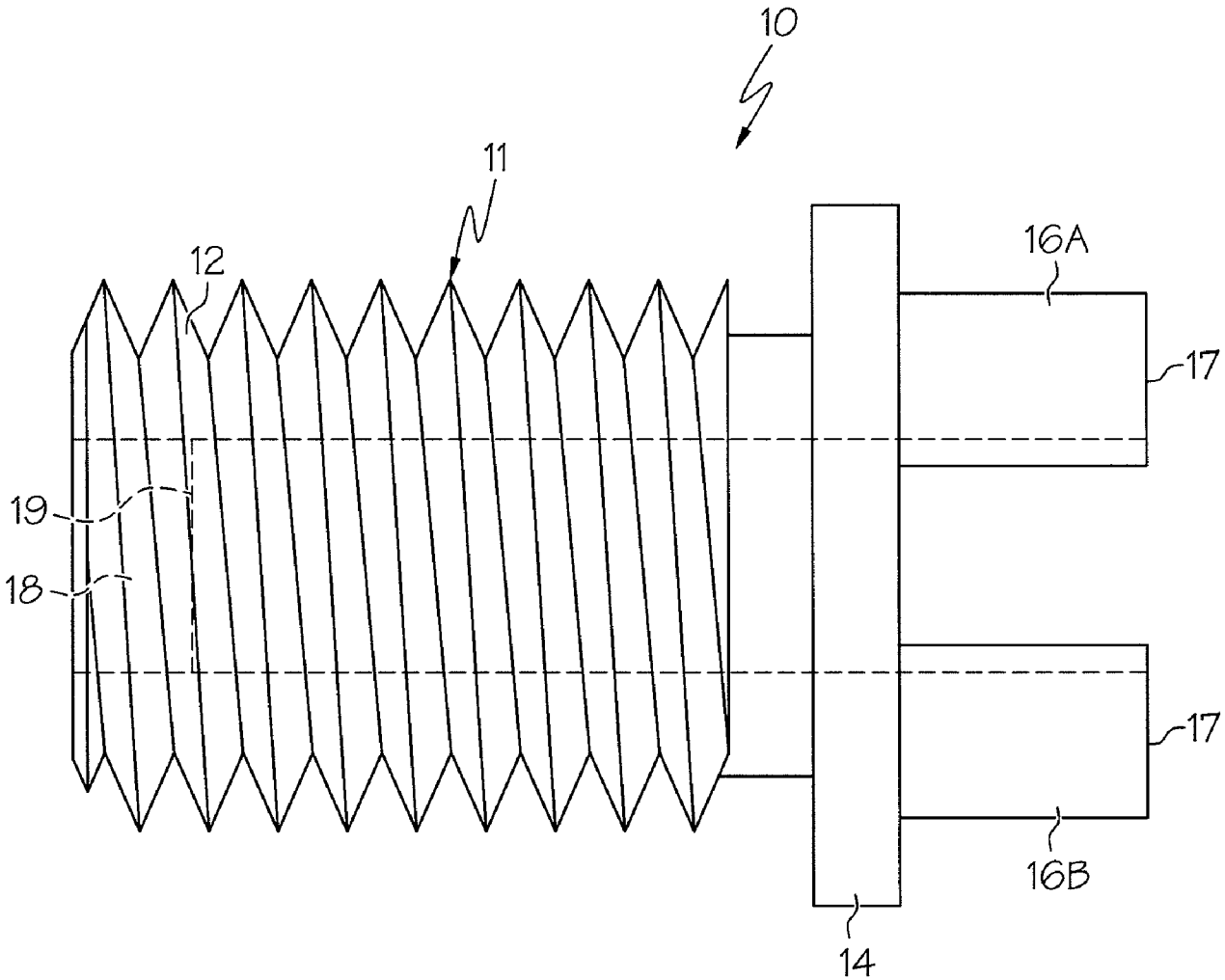
FIG. 1 is a side elevational view of a threaded adapter of the interchangeable handle system of the present invention.

As shown in FIG. 1, the plunger and interchangeable handle system of the present invention, generally designated 10 (see FIG. 5), includes a threaded adapter 11 having a threaded shaft 12, mating flange 14, barrel engaging wings 16A, 16B, and plunger receiving-recess 18. Recess 18 extends the entire length of shaft 12 and flange 14. Preferably, recess 18 may include a hex socket 19. Flange 14 may be circular in shape, but also may be other shapes, such as hexagonal, without departing from the scope of the invention.

Figure 2:
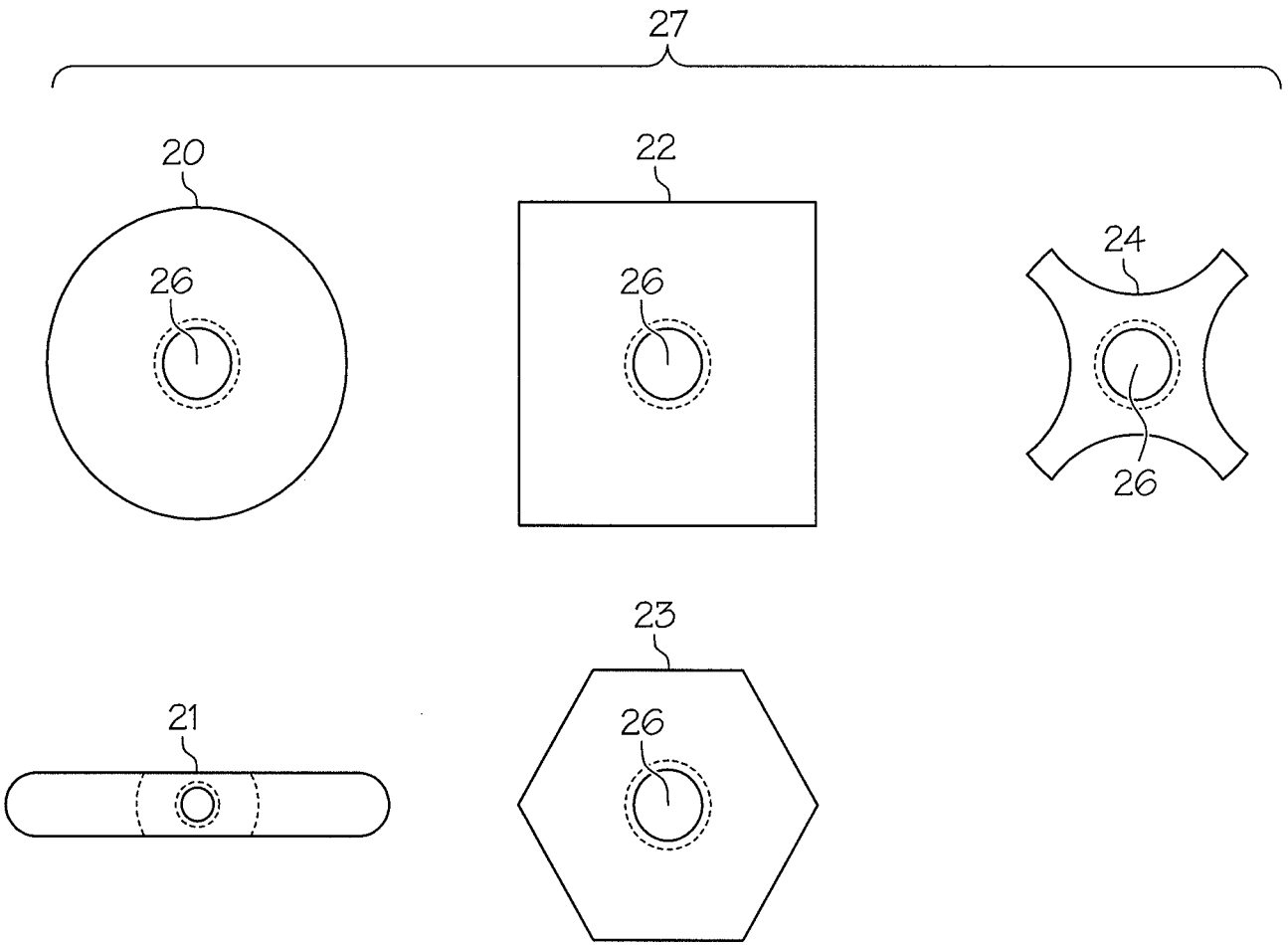
FIG. 2 are end elevational views of differently shaped knobs of the system of the present invention that may be attached to the threaded adapter of FIG. 1.

As shown in FIG. 2, the plunger and interchangeable handle system 10 includes knobs 20, 21, 22, 23, 24. Knobs 20, 21, 22, 23, 24 may be of various shapes, sizes and compositions. For example, knob 20 may be spherically shaped, knob 21 T-shaped, knob 22 cube shaped, knob 23 hex shaped and knob 24 cruciform in shape. Each of the knobs 20-24 includes a central threaded insert or socket 26 shaped to engage the threads of threaded adapter 11. Knobs 20-24 comprise the handle system, generally designated 27, of the plunger and handle adapter 11. However, it is within the scope of the invention to provide additional knobs of different shapes.

It is the purpose of the present invention to provide a retractable plunger with an interchangeable handle system that utilizes many different knob geometries. Increasing the number of optional knob geometries, sizes and compositions, increases the probability that a user will have a plunger having a knob of a desired, or more practical, shape for a specific application.

The socket 26 of knobs 20-24 may be comprised of metal, polymer or other rigid material. Similarly, the knobs 20-24 may be comprised of rigid material such as metal, a polymer such as nylon, phenolic resin or polycarbonate, wood, or other material.

Figure 3:
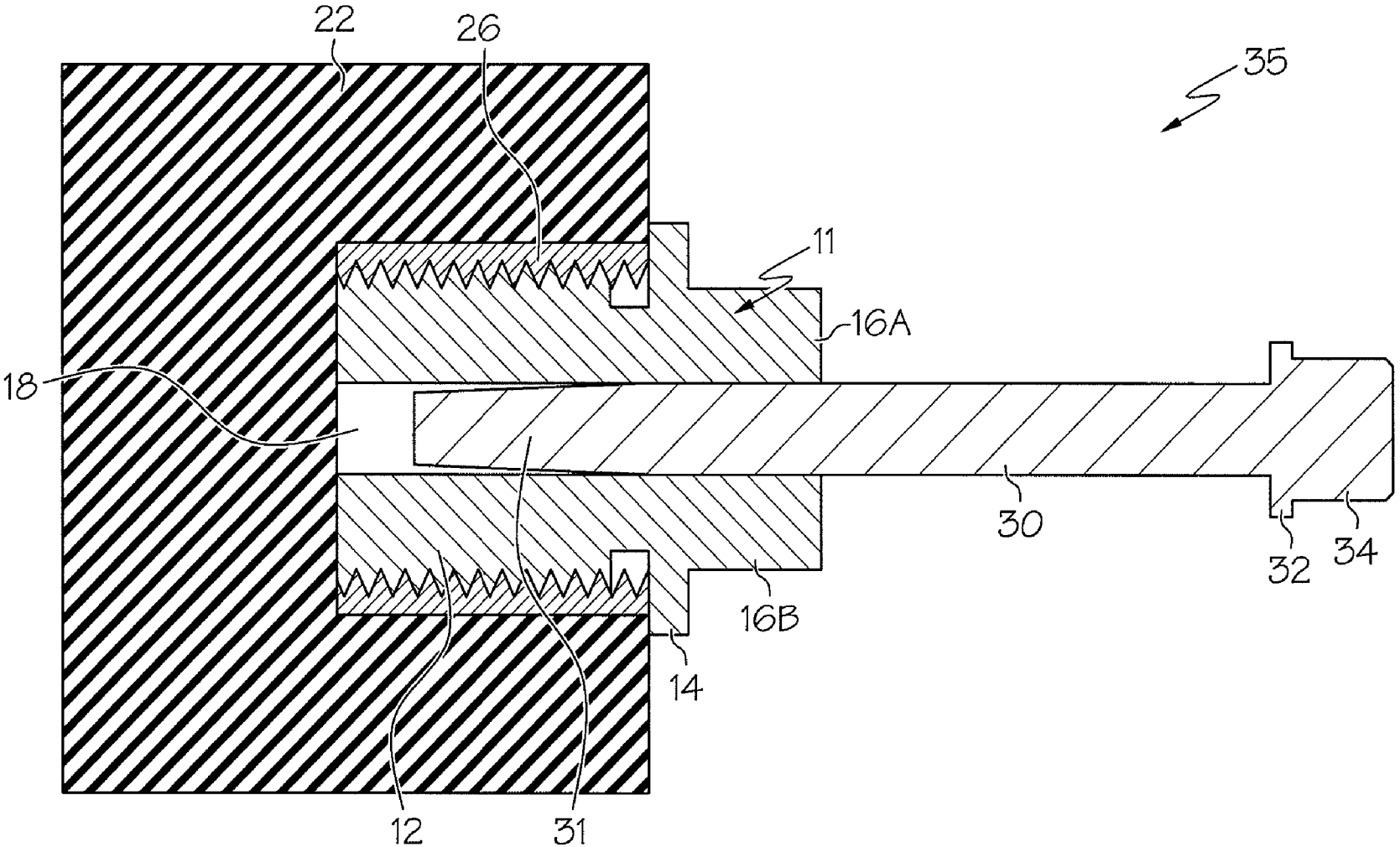
FIG. 3 is a side elevational view, in section, of the cube-shaped knob of FIG. 2 attached to a shank portion of the interchangeable handle system of the present invention.

As shown in FIG. 3, knob 22 (for example) is attached to threaded adapter 11 by screwing the threaded shaft 12 into the socket 26. The knob 22 is tightened onto the threaded adapter 11 until the knob 22 is flush against mating flange 14. According to the present invention, if desired, the cube-shaped knob 22 may then be unscrewed from the threaded adapter 11 and replaced with, for example, spherical-shaped knob 20 or cruciform-shaped knob 24 (see FIG. 2).

Elongated pin 30, having a tapered tip 31, may be press-fitted into recess 18 of threaded adapter 11, thereby forming a shank portion 35. The press-fitting process creates such a solid, unitary component comprised of elongated pin 30 and threaded adapter 11. The elongated pin 30 may include a circular flange 32 and an engaging tip 34.

Figure 4:
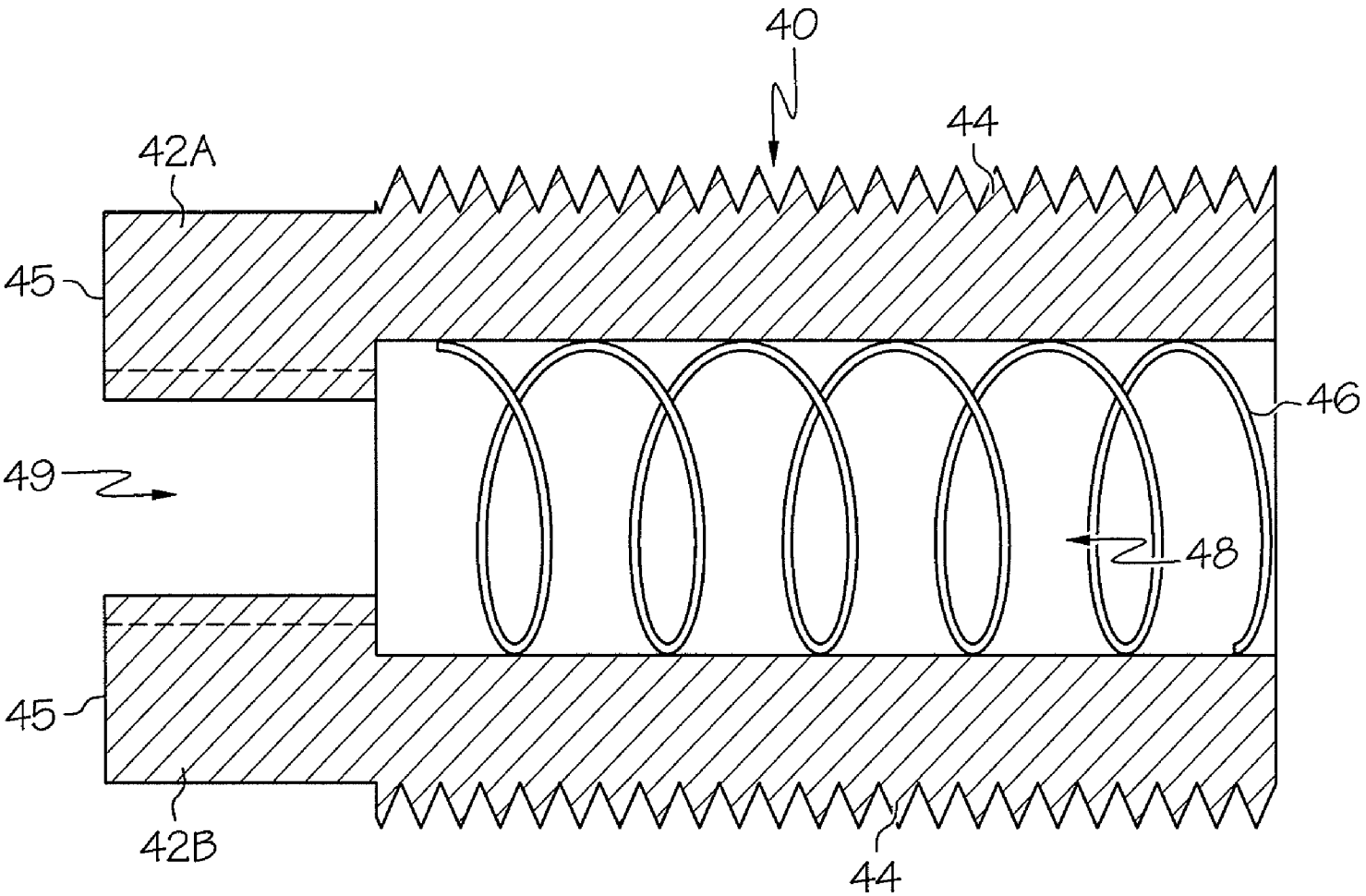
FIG. 4 is a side elevational view of a threaded barrel portion, in section, and a biasing spring of the present invention.

As shown in FIG. 4, the threaded barrel portion 40 of the present invention includes adapter-engaging wings 42A, 42B, equipment-engaging threads 44, biasing spring 46 and cylindrical plunger recess 48. The equipment-engaging threads 44 of the threaded barrel portion 40 may be threaded into a threaded recess of a machine tool (not shown) so that the hand retractable plunger can be used as a positioner, loading pin, indexing device or the like.

Figure 5:
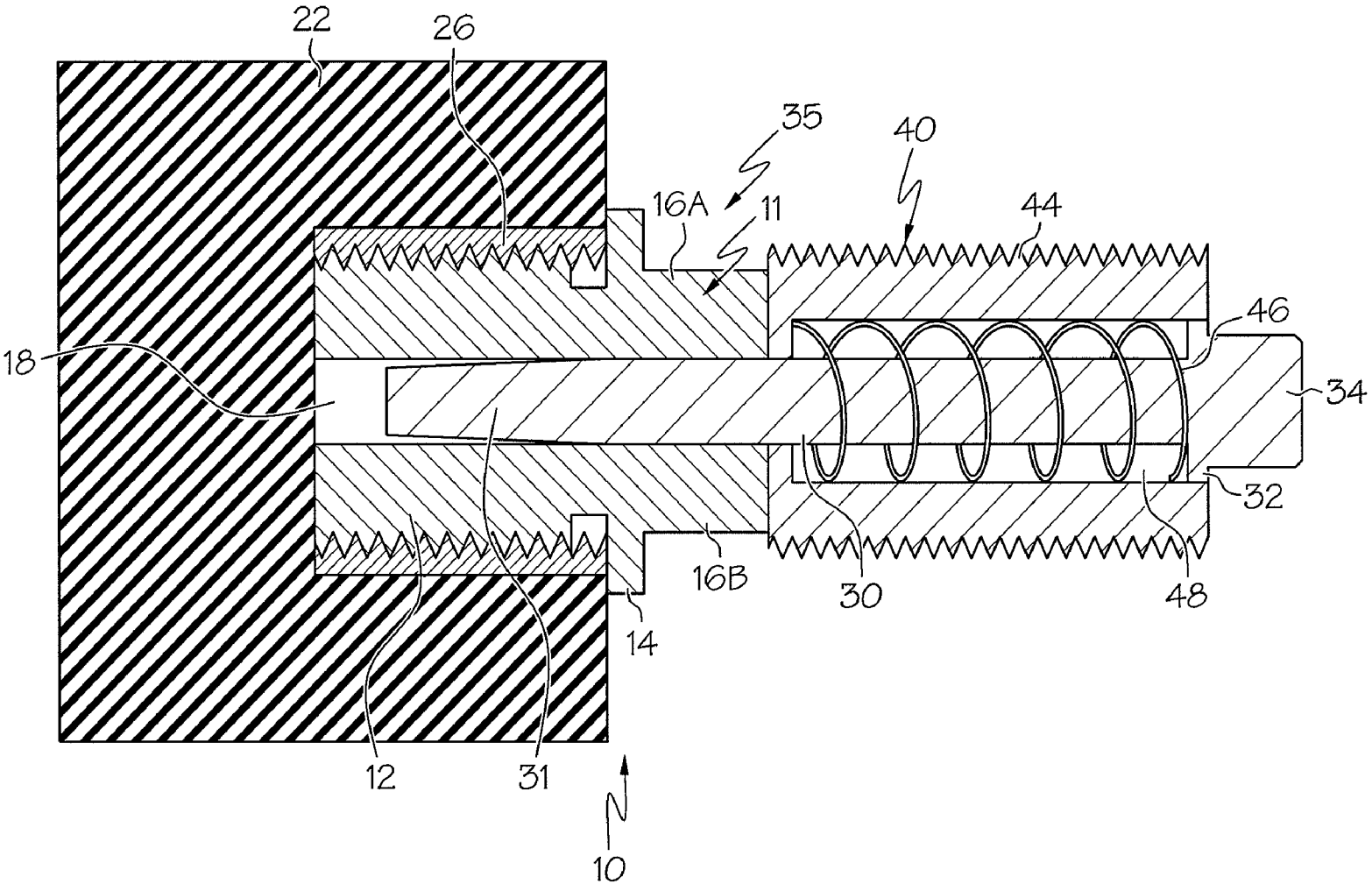
FIG. 5 is a side elevational view, in section, of the shank portion of FIG. 3 attached to the threaded barrel portion of FIG. 4.

As shown in FIG. 5, the threaded barrel portion 40 mates with the threaded adapter 11 such that barrel-engaging wings 16A, 16B slidably fit into a gap 49 between adapter-engaging wings 42A, 42B. The threaded barrel portion 40 and threaded adapter 11 are interconnected by biasing spring 46 and fixed in mating position when elongated pin 30 is moved through cylindrical plunger recess 48 and press-fitted into plunger-receiving recess 18 of threaded adapter 11.

The elongated pin 30 moves axially through the threaded barrel portion 40 and is biased such the engaging tip 34 protrudes from the threaded barrel portion 40, as shown in FIG. 5. The biasing spring 46 biases the elongated pin 30 into an engaging position by exerting a force on flange 32, thereby moving the elongated pin 30 into a protruding engagement position.

The elongated pin 30 may be retracted by grasping the knob 22 and pulling the knob relative to the barrel portion 40, thereby withdrawing the engaging tip 34 within the recess 48. The pin 30 may then be locked in a retracted position by rotating the knob 22 and adapter 11 relative to barrel portion 40 such that shank portion 35 rotates and the flat end surfaces 17 of wings 16A, 16B (FIG. 1) are in contact with the flat end surfaces 45 of wings 42A, 42B (FIG. 4). In an alternate embodiment, wings 16A, 16B may be shortened such that a position of the tip 34 protrudes when the pin 30 is locked in the retracted position so that the plunger will engage a part even when in the retracted position.

Although the invention is shown and described with respect to certain embodiments, it is obvious that equivalents and modifications will occur to those skilled in the art upon reading and understanding the specification. The present invention includes all such equivalents and modifications and is limited only by the scope of the claims.

What is claimed is:

1. A method for configuring a handle used on a machine tool comprising the steps of:

providing a shank shaped to engage a machine tool, said shank including an elongated pin and a threaded adapter, said elongated pin including an engaging tip;

providing a threaded barrel portion defining a plunger recess and including a threaded portion and a biasing spring;

positioning said threaded barrel portion over said shank such that said threaded barrel portion is movably received over said elongated pin such that said elongated pin extends through said plunger recess, wherein said biasing spring urges said engaging tip relative to said threaded barrel portion in a direction away from said threaded adapter;

providing a plurality of knobs, each of said plurality of knobs having a discrete shape differing from the others of said plurality of knobs, and each of said plurality of knobs including a socket; and attaching a selected one of said plurality of knobs to said shank by engaging said socket with said threaded adapter.

2. The method of claim 1 further comprising the step of fixedly inserting a threaded insert into said socket.

3. The method of claim 2 wherein said attaching step includes the step of engaging said threaded insert with said threaded adapter.

* * * * *